US005411231A

United States Patent [19]

Buck

[11] Patent Number: 5,411,231

[45] Date of Patent: May 2, 1995

[54] MAGNETIC ATTACHMENT MEANS OF NON-MAGNETIC ACCESSORIES TO METAL DOORS

[76] Inventor: Richard F. Buck, 1707 Lotus Dr., Orefield, Pa. 18069

[21] Appl. No.: 167,229

[22] Filed: Dec. 14, 1993

[51] Int. Cl.[6] ..... A47G 1/17

[52] U.S. Cl. ..... 248/206.5; 248/206.2

[58] Field of Search ..... 248/345.1, 206.5, 205.8, 248/205.5, 205.6, 205.8, 206.2, 206.3, 309.4, 363; 294/64.1, 65.5

[56] References Cited

U.S. PATENT DOCUMENTS

| | | | |
|---|---|---|---|
| 710,041 | 9/1902 | Clark | 294/65.5 |
| 1,001,689 | 8/1911 | Rogers | 294/65.5 X |
| 1,598,559 | 8/1926 | Cohen | 248/205.6 |
| 1,641,880 | 9/1927 | Cohen | 248/205.6 X |
| 2,047,517 | 7/1936 | McKittrick | 65/61 |
| 2,117,132 | 5/1938 | Baermann | 294/65.5 X |
| 2,297,806 | 10/1942 | Smith | 120/108 |
| 2,483,697 | 10/1949 | Giles | 90/59 |
| 2,642,248 | 6/1953 | Semon | 248/206 |
| 2,815,236 | 12/1957 | Lowinski | 292/251.5 |
| 3,147,176 | 9/1964 | Haslam | 248/345.1 X |
| 3,178,620 | 4/1965 | Berker, Sr. | 317/159 |
| 3,196,548 | 7/1965 | Moore | 248/206.5 X |
| 3,258,237 | 6/1966 | Beiman | 248/225 |
| 3,309,129 | 3/1967 | Newman | 248/345.1 X |
| 3,325,639 | 6/1967 | King | 248/205.6 X |
| 3,365,684 | 1/1968 | Stemke et al. | 335/302 |
| 3,533,035 | 10/1970 | Gili | 335/285 |
| 4,985,817 | 1/1991 | Yale | 248/206.5 X |
| 5,192,043 | 3/1993 | Fa | 248/363 X |

*Primary Examiner*—J. Franklin Foss
*Attorney, Agent, or Firm*—Sanford J. Piltch

[57] ABSTRACT

A device for removably holding a non-magnetic object to a selectable location on a magnetic component without penetrating the surface of the magnetic component is disclosed. The device is particularly suited for holding a non-magnetic coat hanger arrangement or a non-magnetic kick plate either or both onto a steel door commonly found in industrial, commercial and domestic applications. The device comprises a magnet and means for varying the intensity of the magnetic field between the magnet and the steel door so that the device is snugly attached thereon, yet removable therefrom in a snap-action manner.

4 Claims, 2 Drawing Sheets

FIG. 1
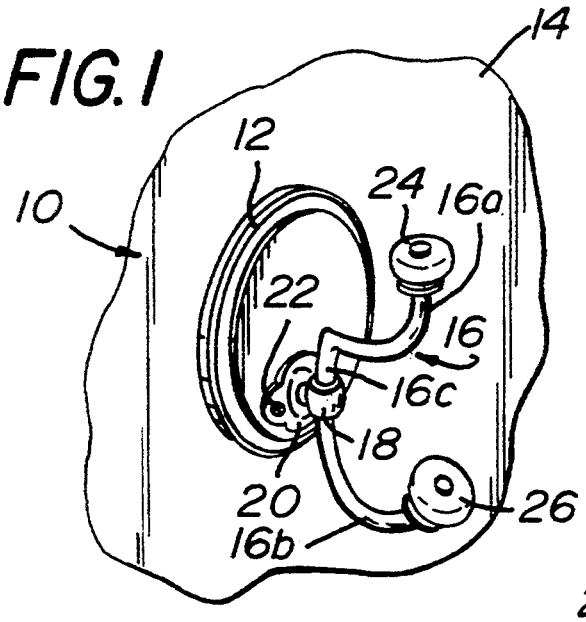
FIG. 2
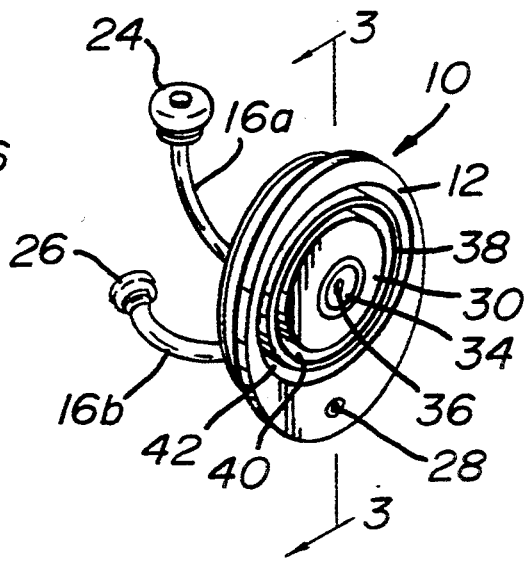
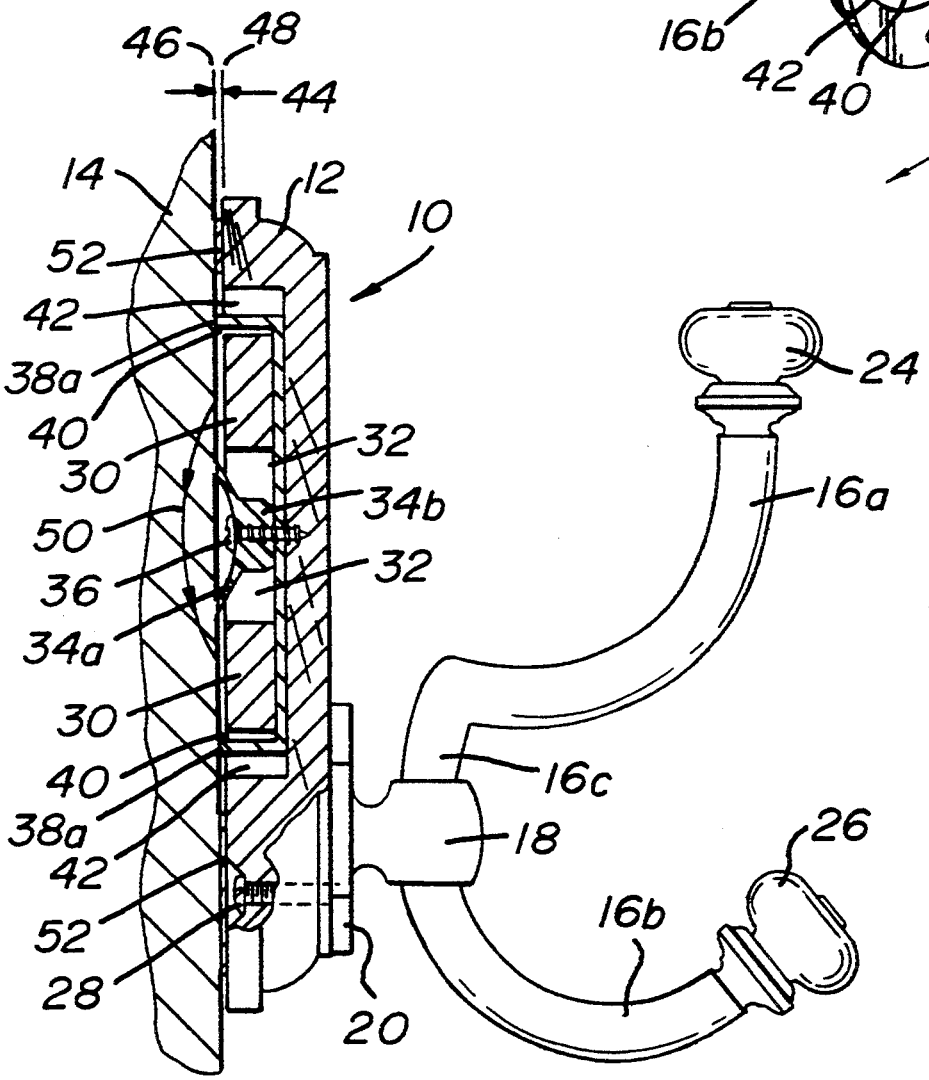
FIG. 3

MAGNETIC ATTACHMENT MEANS OF NON-MAGNETIC ACCESSORIES TO METAL DOORS

FIELD OF THE INVENTION

The present invention relates to a device for snugly, but removably, attaching a non-magnetic object to a magnetic object without physically penetrating the surface of the magnetic object and, more particularly, to a device having a magnet connected to a non-magnetic, coat hanger, door knocker and other decorative apparatus and means for varying the intensity of the magnetic field between the magnet and the magnetic object, such as a door containing ferrous metal, so that the various apparatus may be attached to and removed from the steel door in a snap-action manner.

BACKGROUND OF THE INVENTION

Doors, formed of a magnetic material, such as steel, that swing or slide provide a barrier by which an entry is closed and opened, are becoming more popular for both interior and exterior usage in industrial, commercial, and, most recently, domestic applications. Domestic use of steel doors is increasing so as to provide entrance/exit barriers that are less apt to provide thermal leaks and, therefore, provide increased environmental integrity for the home. Industrial and commercial usage of steel doors have been used over the years so as to provide a barrier to serve as a fire door and now their usage is also increasing in these applications because of their burglarproof features.

Steel doors, while having many advantages, do have certain drawbacks as compared to wooden doors, especially concerned with the mounting of door accessories, such as coat hanger arrangements or kick plates. These accessories are relatively easy to attach to a wooden door when compared to the effort required for such attachment to steel doors that normally necessitates the need for drilling, so that hardware may be connected thereto for accepting the accessory. It is especially disadvantageous when the accessory is only temporarily attached to the steel door because when the accessory is removed it may very well create rust-out and/or water leakage problems caused by the remaining holes and screws that were necessary for the original mounting of such an accessory to the steel door. It is desired that a device be provided that will allow accessories to be attached to a steel door on a permanent or temporary basis without causing any harm to the door that would eventually lead to creating rust-out and/or water leakage problems.

It is, therefor, a principle object of the present invention to provide a device carrying an accessory that is attachable to a steel door, or to any magnetic object, without causing any physical penetration into the surface of the magnetic object that might otherwise create rust-out or metal corrosion water leakage, or other surface integrity problems.

Another object of the present invention is to provide a device carrying a non-magnetic accessory to be snugly, but removably, attached to a magnetic object, such as a ferrous metal door.

Further, it is an object of the present invention to provide a device that easily is attached to and removed from a ferrous metal door so that placement positioning and replacement is readily achievable.

Still further, it is an object of the present invention to provide a device that is non-invasively attached to a metal door and which absorbs a blow or sudden forceful thrust with the foot so as to serve as a kick plate.

Furthermore, it is an object of the present invention to provide a device that allows for various non-magnetic objects to be non-invasively attached to a ferrous metal door.

Further still, it is an object of the present invention to provide a device which allows a non-magnetic object to be non-invasively attached to a selectable portion of a magnetic object.

SUMMARY OF THE INVENTION

The present invention relates generally to a device that removably attaches a non-magnetic object to a magnetic object. Specifically, this invention relates to a device that non-invasively attaches a non-magnetic object, such as a coat hanger arrangement or a kick plate, to a ferrous metal door.

The removable holding device comprises a magnet having two faces, a non-magnetic object, means for connecting the non-magnetic object, a magnetic object, and means for varying the intensity of a magnetic field. The means for connecting provides for the non-magnetic object to be connected to one face of the magnet. The magnet and the magnetic object comprise a magnetic circuit and the magnet creates a magnetic field having a pre-determined intensity. The magnet is positioned so that its other face is directed toward the magnetic component and establishes a magnetic field therebetween. The means for varying the intensity of the magnetic field is interposed between the magnet and the magnetic component and allows the magnet and magnetic component to be snugly attached, with its position reliably maintained, and disconnected one from the other in a snap-action manner.

BRIEF DESCRIPTION OF THE DRAWINGS

For the purpose of illustrating the invention, there are shown in the drawings embodiments which are presently preferred; however, it should be understood, that the invention is not limited to the precise arrangements and instrumentalities shown.

FIG. 1 is an isometric view of one embodiment of the present invention of a device for removably holding a non-magnetic door accessory on a ferrous metal door.

FIG. 2 is an isometric view of the rear of the attachment device of FIG. 1.

FIG. 3 is a cross-sectional view of the device of FIG. 1, taken along line 3—3 of FIG. 2.

DETAILED DESCRIPTION OF THE PREFERRED EMBODIMENTS

Figure 4:
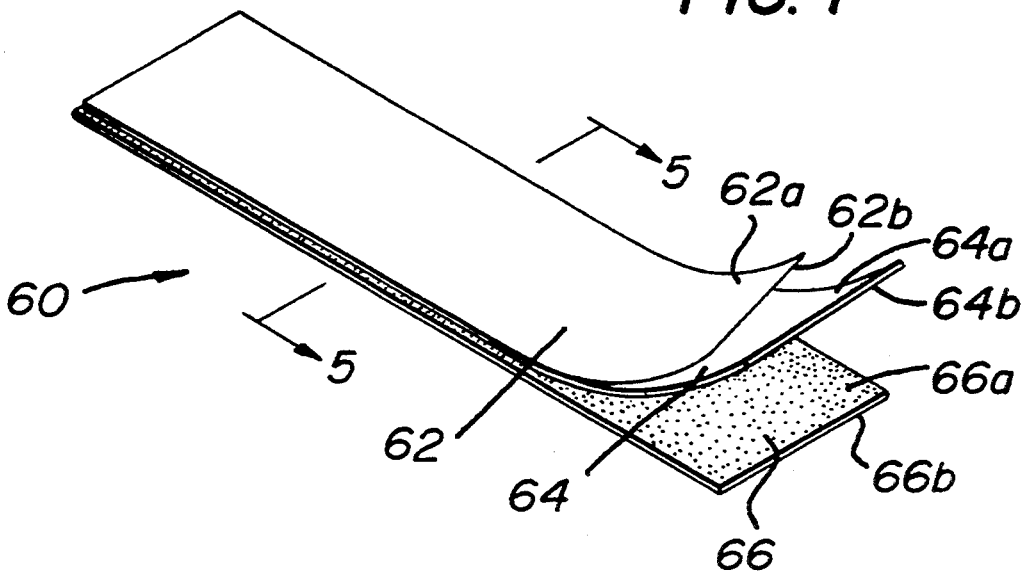
FIG. 4 is an isometric view of a second embodiment of the present invention of a device for removably holding a non-magnetic kick plate to a ferrous metal door.

The following detailed descriptions are for the best presently contemplated modes of carrying out the present invention. These descriptions are not intended in any limiting sense, but rather are made solely for the purpose of illustrating the general principles of the invention.

Referring now to the drawings in detail, wherein like numerals indicate like elements, there is shown in FIG.

1, a device 10 of the present invention for releasably holding a non-magnetic object 12 onto a selectable location on a magnetic component 14 without penetrating the surface of the magnetic component 14. The device 10 of the present invention is particularly suited for holding a non-magnetic object, such as a wooden member 12 carrying a coat hanger arrangement comprising a hook 16, onto a magnetic object, such as a steel door 14 commonly found in industrial, commercial, and domestic applications. The device 10 non-invasively holds the coat hanger arrangement 16 in place on the steel door 14 so as to prevent any rust-out and/or water leakage problems, discussed above, commonly occurring when the coat hanger arrangement is removed from the steel door. Not only may a coat hanger arrangement be non-invasively attached for the steel door, but various door accessories may be attached by the devices of the present invention in a manner as to be more fully described hereinafter.

The object 12 may have any desired shape, such as its oval shape shown in FIG. 1, and is preferably made of wood having at least one hook member 16 attached thereto so as to form a coat hanger arrangement. However, the member 12 may be of any non-magnetic material, such as plastic. The present invention accommodates the attachment, permanent or temporary, of all types of non-magnetic accessories to the steel door 14. The hook 16, shown attached to the oak plaque 12 of FIG. 1, has a first end 16*a*, a second end 16*b*, and a central portion 16*c* about which is rigidly affixed a barrel member of a first attachment means 18. The first attachment means 18 is centrally disposed within a second attachment means 20 which, in turn, is affixed to the oval plaque 12 by means of screw members 22, only one of which is shown in FIG. 1. The first end 16*a* and second end 16*b* respectively have ceramic members 24 and 26 connected at their respective ends. The hook means 16, first attachment means 18, second attachment means 20, and screws 22 are all preferably formed of a non-rusting material, such as brass. The use of such non-rusting elements is particularly advantageous when the face of the steel door 14, to which the non-magnetic object 12 is attached, is exposed to the outdoor environment. The holding device 10 may be further described with reference to FIG. 2.

FIG. 2 illustrates the rear of the releasably holding device 10 as seen when the device 10 is removed from the steel door 14. FIG. 2 illustrates the lower portion of the wooden plaque 12 as having a fastener means 28, such as a screw, whereas FIG. 2 illustrates the central region of the wooden plaque 12 as housing a magnet 30 having a central aperture 32 (not shown in FIG. 2, but shown in FIG. 3), a suction attachment member 34 having an exposed face 34*a*, a fastening means 36, a cup member 38, a first channel 40 defined by the spacing between the magnet 30 and the cup member 38, and a second channel 42 defined by the spacing between the cup member 38 and the outer periphery of the central region of the wooden plaque 12.

The magnet 30 preferably has a donut shape and has flat, smooth top and bottom portions. Further, as used herein, the magnet 30 has an inner face directed toward the wooden plaque 12 and an outer face directed toward the steel door 14. The suction member 34 is of a non-metallic material and is flexible. The cup member 38 is preferably of a ferrous material and is positioned between the magnet 30 and the wooden plaque 12 and is proximate contact with both the magnet and the wooden plaque. The attachment of the metal cup member 38, as well as the magnet 30 and suction member 34, may be further described with reference to FIG. 3, which is a view taken along line 3—3 of FIG. 2 and which illustrates the releasably holding device 10 as mating with and attached to the steel door 14.

As shown in FIG. 3, the magnet 30 is preferably attached to the metal cup member 38 by means of a thin adhesive coating of a well known and commercially available epoxy, and similarly, the metal cup member 38 is also preferably attached to the wooden plaque 12 by a thin epoxy coating. To fixedly secure the magnet 30, the metal cup member 38 and the suction attachment member 34 is inserted through the suction attachment member base 34*b* and the cup member 38. The flexible base 34*b* provides additional force to retain the cup member 38 in position, against the plaque 12. The metal cup member 38 is preferably attached to the wooden plaque 12 by a thin coating 46, also being an epoxy. The metal cup member 38 comprises the means for connecting the non-magnetic wooden plaque 12 to the face of the magnet 30 that is not exposed to the steel door. As is further seen in FIG. 3, a major portion of the exposed face 34A of suction member 34 mates with and engages the surface of the steel door 14. As shown in the bottom portion of FIG. 3, partially cut away, the screw member 28 is inserted into and threadedly engages an extension member 18A of the first attachment means 18.

In addition to serving as the means for connecting the non-magnetic object, such as the wooden plaque 12, to the inner face of the magnet 30, the metal cup member 38 has a peripheral lip 38*a* which serves as a means to provide an air gap between the steel door 14 and the outer face of the magnet 30. As shown in the uppermost portion of FIG. 3, the lip 38*a* extends outward from the outer face of the magnet 30 by a fixed distance to create an air gap 44. The gap 44 is defined by the space existing between the plane 46 of the outer surface of the steel door 14 and the plane 46 of the outer face of the magnet 30. This air gap 44 serves as the means for varying the intensity of the magnetic field between the magnet 30 and the magnetic component, such as the steel door 14.

The magnet 30 and the steel door 14 serve as two components that provide a magnetic circuit having a closed path 50, shown in FIG. 3 and representative of a magnetic field, The magnetic flux or intensity of the magnetic field 50 is established by the selection of the magnetic parameters of the magnet 30. However, the intensity of the coupling between the magnet 30 and the steel door 14 is varied by the selection of the dimensions of the air gap 44. Furthermore, a medium other than air, such as that provided by a non-magnetic material, is contemplated by the present invention to additionally vary this intensity of coupling.

The magnet 30 allows the non-magnetic object 12 to be snugly but releasably attached to the magnetic object (ferrous metal door 14). The intensity of the magnet 30 and the air gap 48 (having a typical dimension ranging between 1/32 and 3/32 of an inch, preferably about ⅛ of an inch, for the coat hanger arrangement of FIGS. 1-3) are cooperatively selected so that once the wooden plaque 12 is non-invasively attached to the steel door 14, it maintains its location when typically subjected to a weight of approximately 20 pounds, which corresponds to the carrying weight of at least one garment, such as a man's winter overcoat for purposes of this example. The cooperative selection of both elements 30 and 44 to satisfy this 20 pound criterion may be accomplished in a known manner to satisfy any criterion that allows the coat hanger arrangement shown in FIGS. 1–3 to carry as many garments as may be needed to meet particular demands.

Furthermore, the suction member 34, having its exposed face 34*a* mating with the surface of the steel door 14, assists in the carrying of the weight on hook 16 and, more particularly, assists in maintaining the pre-selected location of the wooden plaque 12 on the steel door 14. In particular, the exposed face 34*a* extends outward from the wooden plaque 12 by a sufficient amount to exert a suction or gripping force by reason of creating reduced air pressure over the part of the surface of the steel door 14 with which the exposed face 34*a* mates and engages. The suction device 34 serves a dual purpose by holding in position and preventing gravitational slip of the device 10. It is preferred that the non-magnetic suction device 34 be positioned within the central aperture 32 of the magnet 30, so as not to interfere with the magnetic field 50 created by the magnet 30 and the cup member 38.

For the embodiment of FIG. 3, the wooden plaque 12 may be removed from the steel door 14 merely by subjecting the hook 16 to a snap-action force. The relative ease of removal is provided by the air gap 44 or other non-magnetic medium separating the magnet 30 from the steel door 14. Without the benefits of the present invention, the magnet 30 may otherwise be rigidly engaged with the steel door 14, and any attempt to remove the magnet 30 from the steel door 14 may cause the removal of the paint or other sealant applied to of the steel door 14 which may adhere to the magnet 30 through extended contact. Not only does the air gap 44 formed by lip 38*a* allow for this non-destructive removal, but also because only the lip 38*a* magnetically mates with the steel door 14, the device 10 may be rocked away from the steel door 14 in a snap-action manner.

It should now be appreciated that the practice of the present invention provides for a releasable holding device 10 that allows for a non-magnetic object to be snugly but releasably attached to a magnetic object. More particularly, the present invention provides for a releasable holding device 10 that allows for an accessory, such as a wooden plaque 12 having a coat hanger 16, to be attached to a steel door 14, while still allowing the coat hanger 16 to be removed from the steel door 14 without leaving any permanent scars, such as holes through which screws or other fasteners would attach the hanger, that might otherwise cause rust-out or water leakage problems to occur in the steel door 14.

The present invention may also include one or more friction pad members 52 at the top or bottom of the side of the device facing the steel door 14. The friction pad members 52 fit into the air gap 44, neither increasing or decreasing said spacing, but providing additional frictional contact between the door 14 and the device 10 of the present invention.

A second embodiment of the present invention may be described with reference to FIG. 4. This second embodiment (as shown in FIG. 4) illustrates a kick plate 60 comprising a protective layer or sheet 62 formed of a non-magnetic material and having outer 62*a* and inner 62*b* surfaces, a laminar magnetic strip 64 having outer 64*a* and inner 64*b* surfaces, and a non-magnetic plate 66 (preferably of brass) and having outer 66*a* and inner 66*b* surfaces. The surface 62*b* of the non-magnetic protective layer 62 preferably has an adhesive bond or coating (not shown), such as an epoxy coating so that it becomes rigidly attached to the inner surface 64*a* of the laminar magnetic strip 64. Similarly, the outer surface 64*b* of the magnetic laminar strip 64 preferably has an adhesive bond or coating, such as an epoxy coating, so that it may be rigidly attached to the inner surface 66*b* of the non-magnetic plate 66. The brass plate 66 has its outer surface 66*b* facing outward from the magnetic object, such as a ferrous metal door 14, to which the plate 66 is attached, whereas the inner surface 62*a* of the non-magnetic protective sheet 62 is facing toward the steel door 14 to which it is attached. The kick plate 60 may be further described with reference to FIG. 5 which is a view taken along line 5—5 of FIG. 4 and shows the kick plate 60 as being attached to the steel door 14.

The non-magnetic protective cover or sheet 62 and the laminar magnetic strip 64 are dimensioned slightly smaller than the non-magnetic plate 66 to provide for a fingerhold to apply force to remove the kick plate 60 in the manner to be described below. Further the laminar magnetic strip 64 may alternatively be comprised of several such strips placed in a parallel relationship across the inner surface 66*b* of the non-magnetic plate 66, or be positioned in both a parallel and perpendicular relationship across the plate 66. If desired, and only for cosmetic purposes, the kick plate 60 may further comprise decorative screw heads 68 that are affixed to the brass plate 66 by means of an adhesive bond or coating, such as an epoxy coating.

Figure 5:
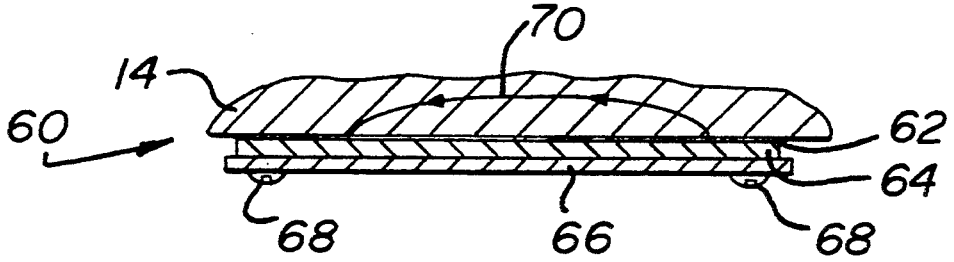
FIG. 5 is a cross-sectional view of the second embodiment of the present invention taken along line 5—5 of FIG. 4.

The non-invasive attachment of the non-magnetic (brass) object 66 to the magnetic object 14, shown in FIG. 5, is accomplished in a similar manner as that already described with reference to FIG. 3. More particularly, the laminar magnetic strip 64 and the steel door 14 comprise the two components of the magnetic circuit having a closed magnetic path 70 representative of the magnetic field therebetween. The magnetic flux or intensity of the magnetic field 70 is established by the selection of the magnetic parameters of the laminar magnetic strip 64, but is varied by the selection of the thickness of the protective layer or sheet 62. The protective sheet 62 operates in a manner similar to that described with respect to the air gap 44 of the first embodiment of the present invention shown in FIG. 3. The magnetic field intensity provided by the laminar magnetic strip 64 and the spacing between the magnetic strip 62 and the steel door 14 (magnetic object) provided by the non-magnetic strip 62 are cooperatively selected so that the kick plate 60 remains in place on the door 14 even when subjected to a sudden forceful thrust of the foot, commonly occurring when the steel door 14 is slid or swung to open a related entry. The selection of the magnetic parameters of the laminar magnetic strip 64 and the thickness of the protective sheet 62 may be accomplished in a manner as respectively described for the magnet 30 and air gap 44 of FIG. 3. Similarly, the removal of the kick plate 60 from the steel door 14 may be accomplished in a snap-action manner along the lines described for the removal of the wooden plaque 12 from the steel door 14 described with reference to FIG. 3.

It should now be appreciated that the practice of the present invention provides a kick plate which includes a non-magnetic material, such as brass, that is snugly, yet releasably attached to the steel door 14 commonly found in industrial, commercial, and domestic applications.

It should also be appreciated that the kick plate described with reference to FIGS. 4 and 5 and the wooden plaque coat hanger arrangement described with reference to FIGS. 1–3, may be both attached, permanently or temporarily, onto a ferrous metal door. Furthermore, simultaneous attachment of a plurality of accessories may be practiced by the present invention.

The present invention may be embodied in other specific forms without departing from the essential attributes thereof and, accordingly, reference should be made to the appended claims rather than to the specification as indicated in the scope of the invention.

I claim:

1. A device for removably holding a non-magnetic object to a magnetic object comprising:

a donut-shaped magnet having two faces and a central aperture creating a magnetic field having a pre-determined intensity;

a non-magnetic object;

means for connecting the non-magnetic object to one face of said magnet said means for connecting comprising a suction device of non-magnetic material concentrically located within said central aperture;

a magnetic component directed toward the other face of said magnet and establishing a magnetic field therebetween; and means, interposed between said magnet and said magnetic component, for varying the intensity of the magnetic field between said magnet and said magnetic component.

2. The device for removably holding a non-magnetic object according to claim 1, wherein said connection means further comprises a metal cup having a lip that faces said magnetic component and extends outward from said magnet by a pre-determined distance so as to establish an air gap between said magnetic component and said magnet which serves as said means for varying the intensity of the magnetic field.

3. The device for removably holding a non-magnetic object according to claim 1, wherein said non-magnetic object is comprised of the group consisting essentially of wood, plastic and other rigid polymer compositions.

4. The device for removably holding a non-magnetic object according to claim 1, wherein said magnetic component is a ferrous metal door.

* * * * *